US006637591B2

(12) United States Patent
Chen

(10) Patent No.: US 6,637,591 B2
(45) Date of Patent: Oct. 28, 2003

(54) SCREWDRIVER HOLDER

(76) Inventor: Kun-Chen Chen, No. 6, Lane 609, Chung-Shan Rd., Sec. 1, Ye-Her Li, Tachia Chen, Taichung Hsien (TW)

( * ) Notice: Subject to any disclaimer, the term of this patent is extended or adjusted under 35 U.S.C. 154(b) by 122 days.

(21) Appl. No.: 09/967,952

(22) Filed: Oct. 2, 2001

(65) Prior Publication Data

US 2003/0062277 A1 Apr. 3, 2003

(51) Int. Cl.[7] ..... B65D 85/20
(52) U.S. Cl. ..... 206/349; 206/481
(58) Field of Search ..... D9/415; 206/349, 206/379, 481; 211/70.6

(56) References Cited

U.S. PATENT DOCUMENTS 4,328,894 A * 5/1982 Edell ..... 206/481
4,450,961 A * 5/1984 Bies et al. ..... 206/349
4,586,615 A * 5/1986 Quitmann ..... 206/349
5,484,056 A * 1/1996 Wood ..... 206/349
5,501,330 A * 3/1996 Betts ..... 206/349
5,906,350 A * 5/1999 Kao ..... 206/349
D413,260 S * 8/1999 Vasudeva ..... D9/415
D429,461 S * 8/2000 Rowlay ..... D9/415
6,241,092 B1 * 6/2001 Vasudeva ..... 206/349
6,283,311 B1 * 9/2001 Lee ..... 211/70.6
6,425,482 B1 * 7/2002 Chiang ..... 206/349

* cited by examiner

*Primary Examiner*—Jim Foster
(74) *Attorney, Agent, or Firm*—Rosenberg, Klein & Lee

(57) ABSTRACT

A screwdriver holder includes a base plate and a bracket detachably mounted on the base plate. The base plate includes a hole defined in an upper portion of the base plate for hanging the screwdriver holder on a suitable place and an connecting portion formed near a bottom of the base plate. The connecting portion is adapted to partially receive the annular lip of the handle of the screwdriver. The bracket is detachably mounted on the connecting portion and adapted to partially receive the annular lip of the screwdriver to hold the screwdriver in place on the screwdriver holder.

7 Claims, 6 Drawing Sheets

SCREWDRIVER HOLDER

BACKGROUND OF THE INVENTION

1. Field of the Invention

The present invention relates to a holder, and more particularly to a screwdriver holder.

2. Description of Related Art

With reference to FIGS. 5 and 6, a conventional screwdriver holder in accordance with the prior art comprises a card (60) with an integral tongue (601) extending from the lower end of the card (60). A through hole (61) is defined near the upper end of the card (60) to hang the card on a hook, horizontal post, nail, etc. Two U-shaped bridges (62) are horizontally and separately formed on the lower end of the tongue (601). A slot (621) is defined by the surface of the bridge (62). A resilient, elastic washer (63) with a central hole (631) is inserted into each U-shaped slot (621) through an opening in the back of the tongue (601).

A screwdriver with a shank is inserted through the central hole (631) in the resilient, elastic washers (63). The screwdriver is held on the holder because the central hole (631) of the resilient washer (63) has a diameter smaller than that of the shank of the screwdriver. Consequently, the screwdriver can be hung on a suitable place by using the suspension display card.

The conventional screwdriver holder in accordance with the prior art can hold the shank of the screwdriver so that the screwdriver can be hung on a wall, but it still has several disadvantages.

1. The card and the resilient, elastic washer are made from different materials. Usually, the resilient, elastic washer is softer than the card to provide a good clamping force. The manufacturer must use two kinds of material during production of the suspension display card.

2. The card and the resilient washer must be manufactured in two distinct processes, and then the resilient flexible washer must be inserted into the slot. The production sequence is inconvenient and needs to be simplified.

3. The scope in which the conventional suspension display card can be used is limited because the conventional suspension display card cannot be used to hold a flat tip screwdriver. The head of the flat tip screwdriver is much wider than the diameter of the central hole in the resilient elastic washer. The head of the flat tip screwdriver will damage or destroy the resilient, elastic washer.

The present invention has arisen to mitigate and/or obviate the disadvantages of the conventional screwdriver holder.

SUMMARY OF THE INVENTION

The main objective of the present invention is to provide an improved screwdriver holder that is easy to use and manufacture.

To achieve the objective, the screwdriver holder in accordance with the present invention includes a base plate and a bracket detachably mounted on the base plate. The base plate includes a hole defined in an upper portion of the base plate to hang the screwdriver holder on a suitable place and an connecting portion formed near a bottom of the base plate. The connecting portion is adapted to partially receive the annular lip of the handle of the screwdriver. The bracket is detachably mounted on the connecting portion and adapted to partially receive the annular lip of the screwdriver to hold the screwdriver in place on the screwdriver holder.

Further benefits and advantages of the present invention will become apparent after a careful reading of the detailed description with appropriate reference to the accompanying drawings.

DETAILED DESCRIPTION OF THE INVENTION

Figure 1:
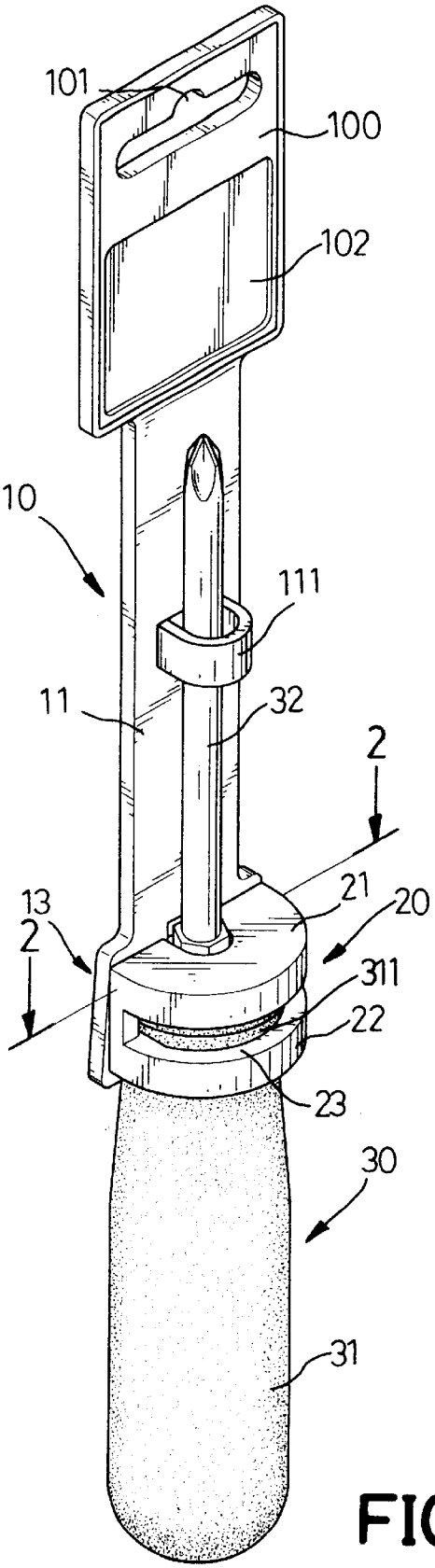
FIG. 1 is a perspective view of a screwdriver holder in accordance with the present invention with a screwdriver.
Figure 2:
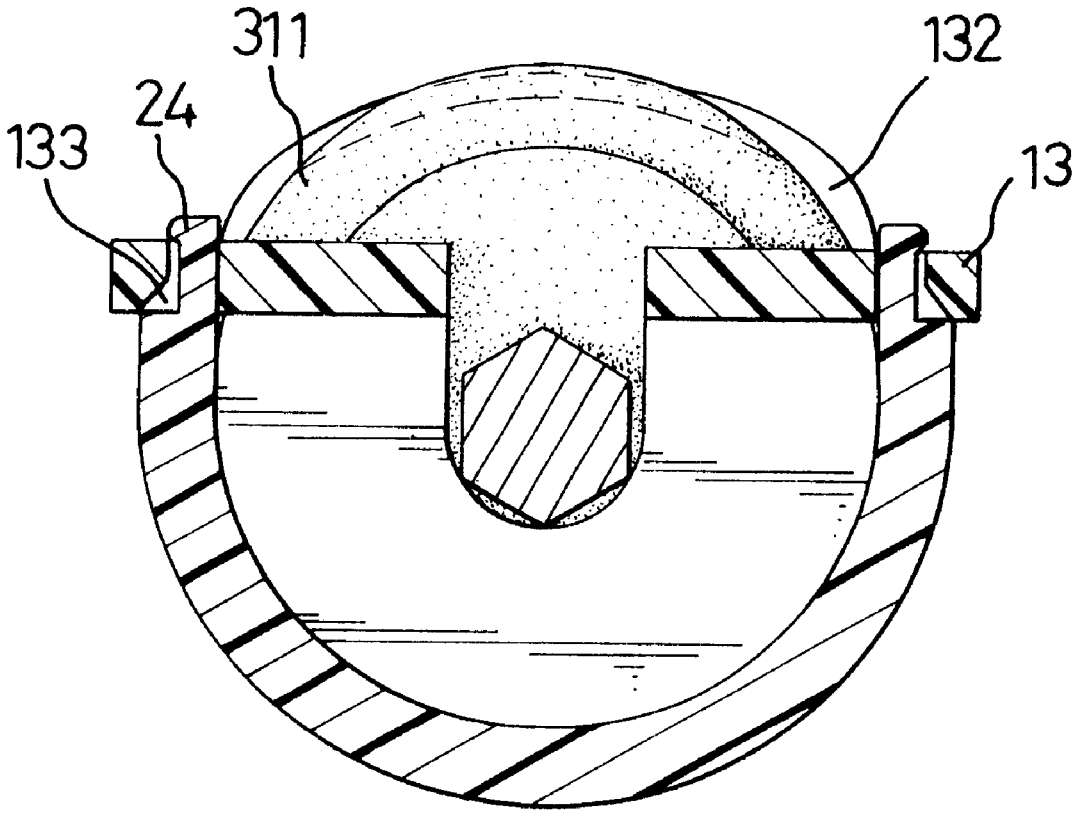
FIG. 2 is a cross sectional top plan view of the screwdriver holder along line 2—2 in FIG. 1.
Figure 3:
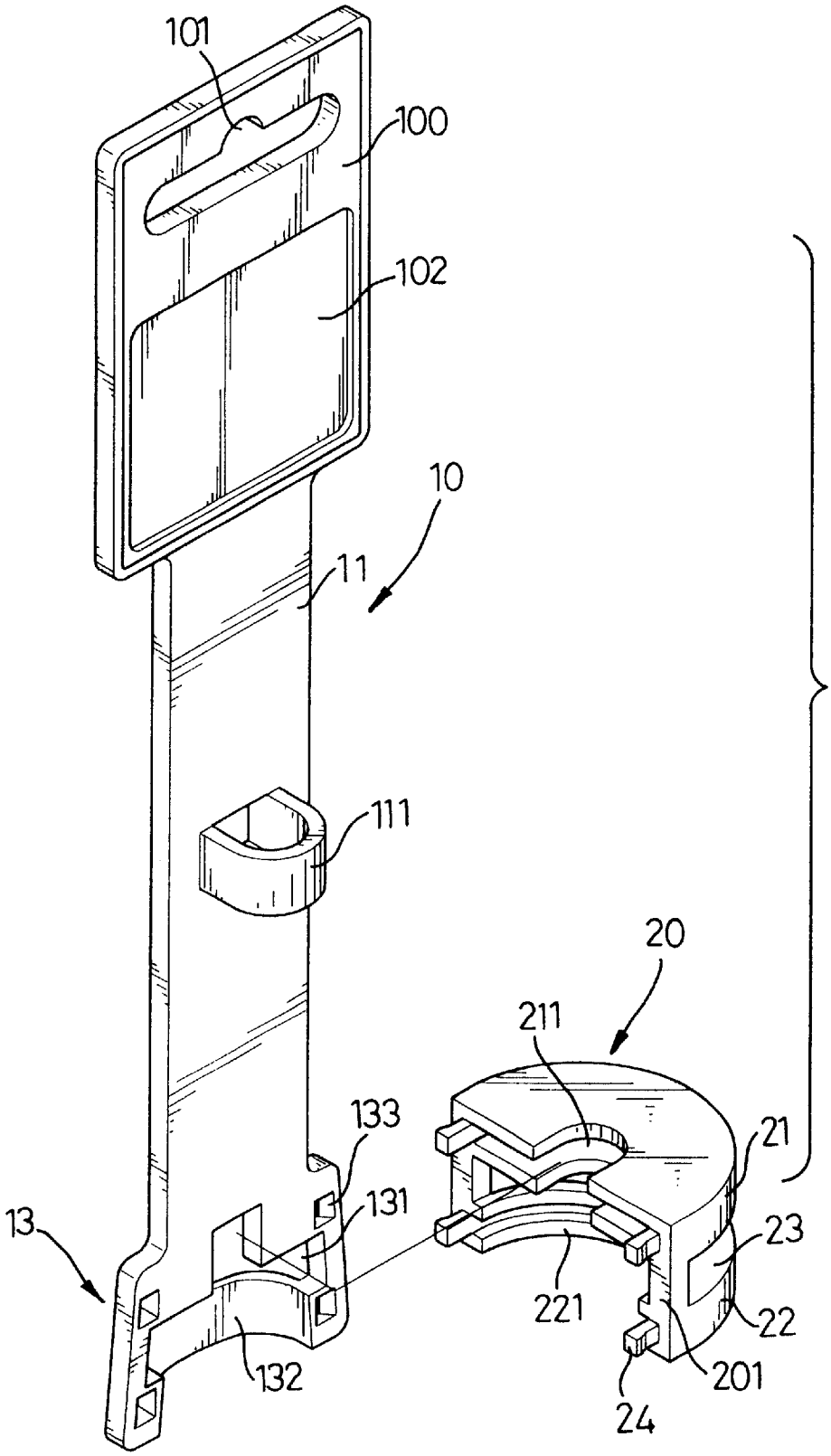
FIG. 3 is an exploded perspective view of the screwdriver holder in FIG. 1.

With reference to the drawings and initially to FIGS. 1–3, a screwdriver holder in accordance with the present invention comprises a base plate (10) and a bracket (20). The base plate (10) has a connecting portion (13) formed on the lower end of the card. The bracket (20) is detachably mounted on the connecting portion (13) to hold a screwdriver in place on the screwdriver holder.

The base plate (10) comprises a card (100), a tongue (11) and a connecting portion (13). The card (100) has a top and a bottom. A hole (101) is defined near the top of the card (100) to hang the screwdriver holder on a hook, horizontal post, nail, etc. An indicating area (102) is formed on the card (100) below the hole (101) to attach a label to show the screwdriver specification and manufacturer.

The tongue (11) has a top end, a free bottom end and a middle portion and extends down from the bottom of the card (100). A closed U-shaped ear (111) is formed horizontally near the middle portion of the tongue (11).

The connecting portion (13) is formed on the free end of the tongue (11) and has a proximal end (not numbered) connected to the tongue (11) and a distal end (not numbered). A slot (131) is horizontally defined in the connecting portion (13), and an arced support (132) is formed on the distal end of the connecting portion (13) below the slot (131). At least two through holes (133) are defined in each longitudinal side of the connecting portion (13). In the preferred embodiment of the present invention, the through holes (133) in the connecting portion (13) are square.

A bracket (20) is detachably mounted on the connecting portion (13). The bracket (20) has a top, a bottom, a first bridge (21) and a second bridge (22). The first and second bridges (21, 22) are horizontal and separated from each other. The first bridge (21) is formed on the top of the bracket (20), and the second bridge (22) is formed on the bottom of the bracket (20). The first bridge (21) includes a first arced recess (211) laterally defined in the first bridge (21) and having an open end directed toward the connecting portion (13). The second bridge (22) includes a second arced recess (221) laterally defined in the second bridge (22) and having an open end directed toward the connecting portion (13). The first recess (211) has a radius smaller than that of the second recess (221). The bracket (20) has a groove (23)

defined between the two bridges (21, 22) and corresponding to the slot (131) in the connecting portion (13) of the base plate (10). The bracket (20) includes a flat face (201) abutting the connecting portion (13) and having at least two hooks (24) extending from the flat face (201) of the bracket (20). The hooks (24) is inserted into a corresponding one of the through holes (133) in the connecting portion (13) and engaged with the connecting portion (13) after extending through the through hole (133) in the connecting portion (13).

A screwdriver (30) usually has a handle (31) and a shank (32) with one end inserted into securely attached to the handle (31). The handle (31) has an annular lip (311) laterally extending from the front of the handle (31). To use the screwdriver holder to hold a screwdriver (30), the shank (32) passes through the U-shaped ear (111) on the tongue (11) and the lip (311) is partially received in the slot (131) in the connecting portion (13). The lip (32) of the screwdriver (30) is supported by the supporter (132) and the second bridge (22) to prevent the screwdriver (30) from detaching from the screwdriver holder when the bracket (20) is attached to and engaged with the connecting portion (13) of the base plate (10).

Figure 4:
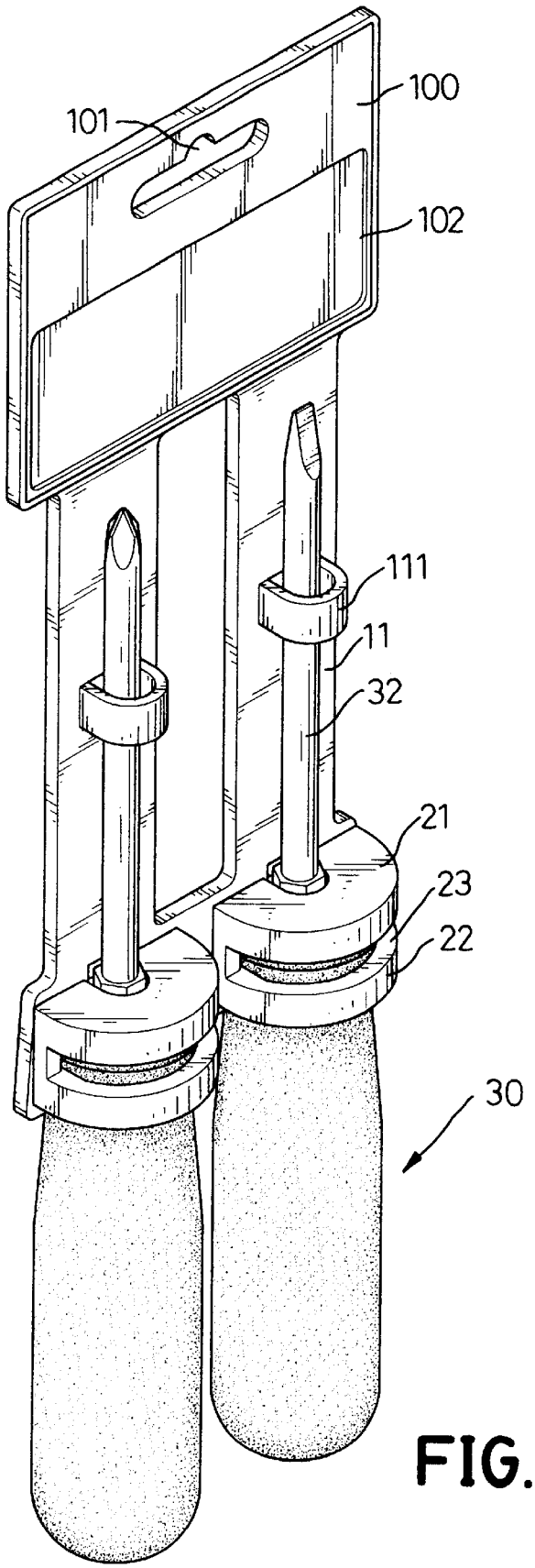
FIG. 4 is a perspective view of another embodiment of a screwdriver holder in accordance with the present invention with two screwdrivers.
Figure 5:
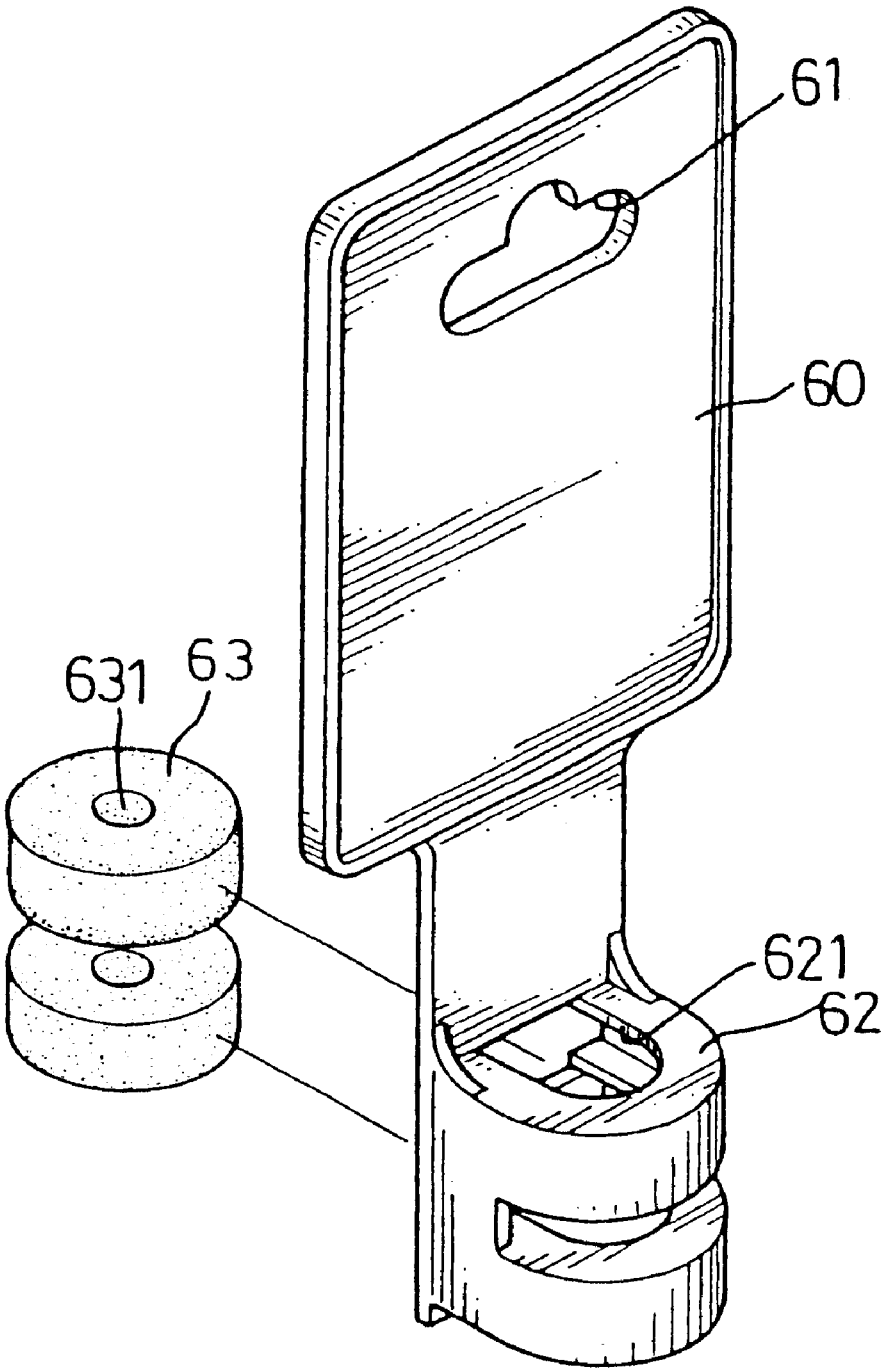
FIG. 5 PRIOR ART
FIG. 5 is an exploded perspective view of a conventional screwdriver holder in accordance with the prior art.
Figure 6:
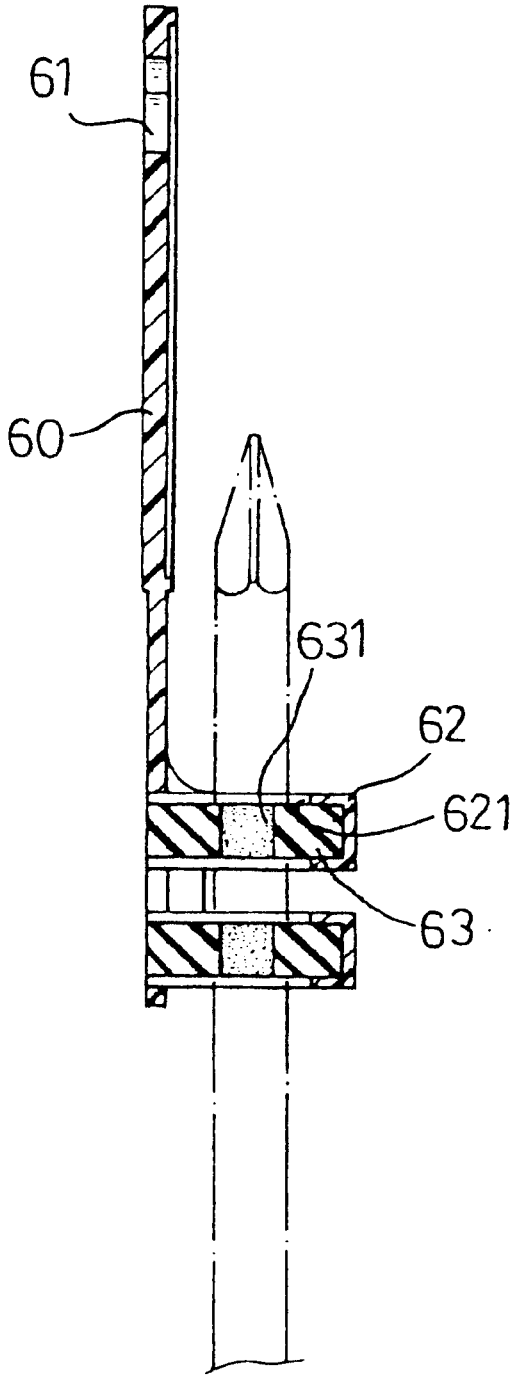
FIG. 6 PRIOR ART
FIG. 6 is a cross sectional side plan view of the screwdriver in FIG. 5.

With reference to FIG. 4, it is another embodiment of the screwdriver holder in accordance with the present invention has a base plate (10) with multiple tongues (11) extending down from the bottom of the card (100). With multiple tongues (11), the screwdriver holder in accordance with the present invention can be adapted to hold multiple screwdrivers in place on the base plate at the same time.

As previously described, the screwdriver holder has the following advantages.

1. The screwdriver holder is easily operated. The shank (32) of the screwdriver (30) passes through the ear (111) and the annular lip (311) is positioned in the slot (131) in the connecting portion (13) and the groove (23) between the two bridges (21, 22) of the bracket (20).

2. The screwdriver holder is easy to manufacture. The base plate (10) and the bracket (20) is respectively formed by injection molding. No assembly is unnecessary.

3. The base plate (10) and the bracket (20) are made of the same material so that the manufacturer just needs to prepare and use only one kind of material during production of the screwdriver holder.

Although the invention has been explained in relation to its preferred embodiment, it is to be understood that many other possible modifications and variations can be made without departing from the spirit and scope of the invention as hereinafter claimed.

What is claimed is:

1. A screwdriver holder for a screwdriver having a shank with one end inserted into and securely attached to a handle which has an annular lip laterally extending from a top of the handle of the screwdriver, the screwdriver holder comprising:

a base plate including:

a hole defined in an upper portion of the base plate for hanging the screwdriver holder a suitable place;

a connecting portion formed near a bottom of the base plate, the connecting portion being adapted to partially receive the annular lip of the handle of the screwdriver;

a bracket detachably mounted on the connecting portion and adapted to partially receive the annular lip of the screwdriver to hold the screwdriver in place on the screwdriver holder;

a card with a top, a bottom and the hole in the base plate defined near the top of the card;

an indicating area formed on the card below the hole for indicating screwdriver specification and manufacturer; and, a tongue with a top end, middle and bottom free end extending down from the bottom of the card and having a closed U-shaped ear horizontally extending from the middle of the tongue, the connecting portion formed on the free end of the tongue.

2. A screwdriver holder for a screwdriver having a shank with one end inserted into and securely attached to a handle which has an annular lip laterally extending from a top of the handle of the screwdriver, the screwdriver holder comprising:

a base plate including:

a hole defined in an upper portion of the base plate for hanging the screwdriver holder at a suitable place;

a connecting portion formed near a bottom of the base plate, the connecting portion for partially receiving the annular lip of the handle of the screwdriver; and, a bracket detachably mounted on the connecting portion and adapted to partially receive the annular lip of the screwdriver to hold the screwdriver in place on the screwdriver holder the connecting portion including:

a horizontal slot defined in the connecting portion to partially receive the annular lip of the handle of the screwdriver;

an arced support formed on a distal end of the connecting portion, the arced support adapted to support the annular lip of the screwdriver; and, at least two through holes defined in each longitudinal side of the connecting portion.

3. The screwdriver holder as claimed in claim 1, wherein the connecting portion comprises:

a horizontal slot defined in the connecting portion, the slot adapted to partially receive the annular lip of the screwdriver;

an arced support formed on a distal end of the connecting portion, the arced support adapted to support the annular lip of the screwdriver; and at least two through holes defined in each longitudinal side of the connecting portion.

4. The screwdriver holder as claimed in claim 2, wherein the bracket comprises:

a first bridge horizontally formed on a top of the bracket and having a first arced recess laterally defined in the first bridge, the first arced recess having an open end directed toward the connecting portion and adapted to receive the shank of the screwdriver;

a second bridge horizontally formed on a bottom of the bracket and having a second arced recess laterally defined in the second bridge, the second arced recess having a radius greater than that of the first arced recess and the second bridge adapted to support the annular lip of the screwdriver;

a groove defined between the first bridge and the second bridge, the groove corresponding to the slot in the connecting portion and adapted to partially receiving the annular lip of the screwdriver when the bracket is mounted on the connecting portion; and a flat face abutting the connecting portion and having at least two hooks extending from the flat face to engaged corresponding through holes in the connecting portion to hold the bracket in place on the connecting portion.

5. The screwdriver holder as claimed in claim 2, wherein the through holes in the connecting portion are square.

6. The screwdriver holder as claimed in claim 3, wherein the bracket comprises:

a first bridge horizontally formed on a top of the bracket and having a first arced recess laterally defined in the first bridge, the first arced recess having an open end directed toward the connecting portion and adapted to receive the shank of the screwdriver;

a second bridge horizontally formed on a bottom of the bracket and having a second arced recess laterally defined in the second bridge, the second arced recess having a radius greater than that of the first arced recess and the second bridge adapted to support the annular lip of the screwdriver;

a groove defined between the first bridge and the second bridge, the groove corresponding to the slot in the connecting portion and adapted to partially receiving the annular lip of the screwdriver when the bracket is mounted on the connecting portion; and a flat face abutting the connecting portion and having at least two hooks extending from the flat face to engaged corresponding through holes in the connecting portion to hold the bracket in place on the connecting portion.

7. The screwdriver holder as claimed in claim 3, wherein the through holes in the connecting portion are square.

* * * * *